US008328967B2

(12) United States Patent
Barbee, Jr. et al.

(10) Patent No.: US 8,328,967 B2
(45) Date of Patent: Dec. 11, 2012

(54) NANO-LAMINATE-BASED IGNITORS

(75) Inventors: Troy W. Barbee, Jr., Palo Alto, CA (US); Randall L. Simpson, Livermore, CA (US); Alexander E. Gash, Brentwood, CA (US); Joe H. Satcher, Jr., Patterson, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 44 days.

(21) Appl. No.: 13/100,154

(22) Filed: May 3, 2011

(65) Prior Publication Data

US 2011/0203714 A1 Aug. 25, 2011

Related U.S. Application Data

(63) Continuation of application No. 10/261,879, filed on Sep. 30, 2002, now Pat. No. 7,951,247.

(51) Int. Cl.
*C06B 23/00* (2006.01)
*D03D 23/00* (2006.01)

(52) U.S. Cl. ..... 149/109.6; 149/15

(58) Field of Classification Search ..... 149/15, 149/109.6
See application file for complete search history.

(56) References Cited

U.S. PATENT DOCUMENTS

| | | | | |
|---|---|---|---|---|
| 4,880,483 | A * | 11/1989 | Baldi | 149/6 |
| 5,090,322 | A * | 2/1992 | Allford | 102/202.7 |
| 5,547,715 | A * | 8/1996 | Barbee et al. | 427/561 |
| 5,650,590 | A * | 7/1997 | Taylor | 149/17 |
| 6,220,164 | B1 * | 4/2001 | Laucht et al. | 102/202.5 |
| 2002/0182436 | A1 * | 12/2002 | Weihs et al. | 428/635 |

* cited by examiner

*Primary Examiner* — Aileen Felton
(74) *Attorney, Agent, or Firm* — John P. Wooldridge

(57) ABSTRACT

Sol-gel chemistry is used to prepare igniters comprising energetic multilayer structures coated with energetic materials. These igniters can be tailored to be stable to environmental aging, i.e., where the igniters are exposed to extremes of both hot and cold temperatures (−30 C to 150 C) and both low (0%) and high relative humidity (100%).

12 Claims, 2 Drawing Sheets

NANO-LAMINATE-BASED IGNITORS

CROSS-REFERENCE TO RELATED APPLICATIONS

This application is a continuation of and claims priority to U.S. patent application Ser. No. 10/261,879 titled "Nano-Laminate-Based Igniters," filed Sep. 30, 2002 now U.S. Pat. No. 7,951,247, incorporated herein by reference.

STATEMENT REGARDING FEDERALLY SPONSORED RESEARCH OR DEVELOPMENT

The United States Government has rights in this invention pursuant to Contract No. DE-AC52-07NA27344 between the U.S. Department of Energy and Lawrence Livermore National Security, LLC, for the operation of Lawrence Livermore National Laboratory.

BACKGROUND

The invention relates to the field of energetic materials. More, specifically, the invention relates to energetic materials useful as igniters.

SUMMARY OF THE INVENTION

Figure 1:
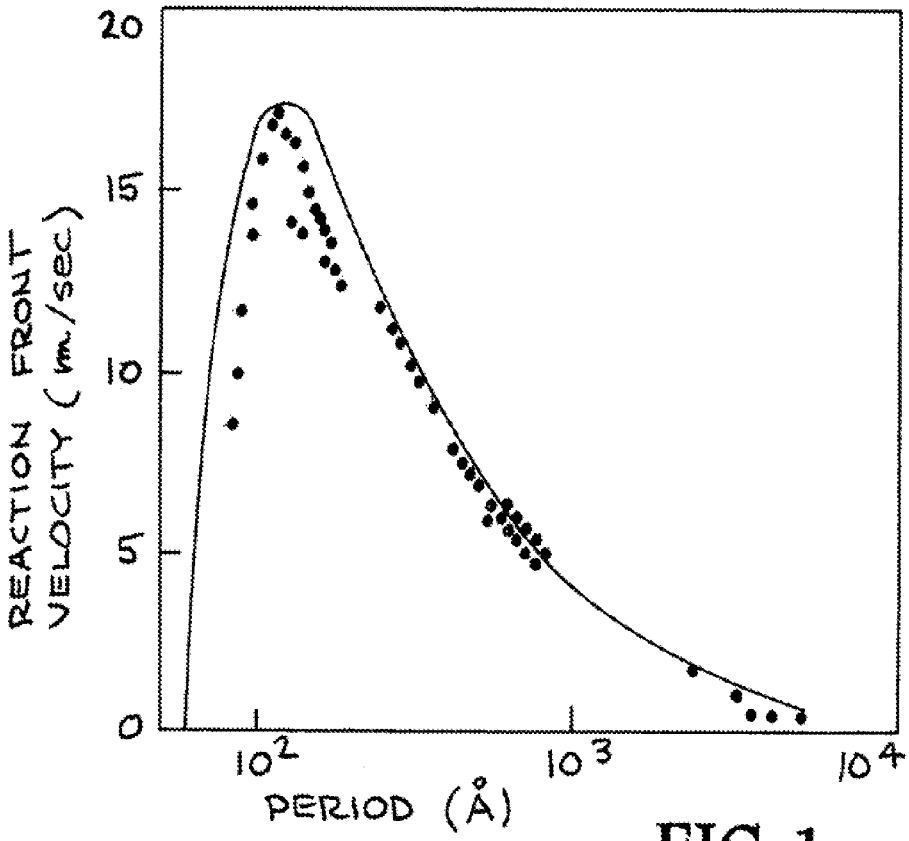
FIG. 1 shows a plot of reaction front velocity vs. period.

An object of the invention is to provide a method including the steps of coating an energetic multilayer structure with an energetic booster material.

The method includes the step of coating an energetic multilayer structure with an energetic booster material, where the booster material is coated onto one end or one side of the multilayer structure, where the energetic booster material comprises a sol-gel nanostructured energetic material. The composition is ignitable by a variety of mechanism, including mechanical stimulation, electrical energy and by a laser. The igniter often has an area ranging from to $10^{-2}$ $m^2$ to $10^2$ $m^2$. The energetic multilayer structure can comprise a bi-metallic multilayer, which may be, e.g., Ni/Al. The sol-gel nanostructured energetic material can be a $Fe_2O_3$/Al nanocomposite. The sol-gel nanostructured energetic material can comprise a nanocomposite selected from the group consisting of $MnO_2$/Al, $WO_3$/Al, $MoO_3$/Al, $V_2O_3$/Al, $MnO_2$/Mg and $Fe_2O_3$/Mg. The sol-gel nanostructured energetic material can comprise a mixture of at least one oxidizer and at least one fuel. At least one of the constituents of the mixture can be less than 100 nm, where the at least one dimension is selected from the group consisting of length, height and width. The step of coating can be accomplished by dip-coating, spin-coating, spray-coating, chemical vapor deposition coating, physical vapor deposition coating, lamination, or gluing.

DETAILED DESCRIPTION

In general, the initiation and detonation properties of energetic materials are dramatically affected by their microstructures. As described by Dagni, R. *Chemical and Chemical Engineering News,* 1999, 77, p. 25-31, it is also known that many physical properties are enhanced or improved in materials called "nanocomposites", which are made from nanoscale building blocks. Nanocomposites are multicomponent materials in which at least one of the component phases has one or more dimensions (length, width, or thickness) in the nanometer size range, usually defined as 1 nm to 100 nm.

Energetic nanocomposites are a class of material that has a fuel component and an oxidizer component intimately mixed on the nanometer scale, and that has at least one of the component phases which meets the size definition. Energetic multilayer structures, also referred to as energetic nano-laminates, are described in U.S. Pat. Nos. 5,538,795 (Barbee, et al.), herein incorporated by reference, and 5,547,715 (Barbee, et al.), herein incorporated by reference. Energetic multilayer structures are made of two or more alternating unreacted layers of known composition.

Combining sol-gel chemistry and multilayer sputtering provides approaches to control structures (e.g., reactant particle sizes and layer dimensions) at the nanoscale, thus enabling the formation of engineerable "energetic nanocomposites". Sol-gel and multilayer sputtering techniques approach to energetic materials offers the possibility to precisely control the composition, purity, homogeneity, and morphology of the target material at the nanometer scale. Composition and morphology are important variables for both safety and reaction rates. Control of these variables is a result that is difficult, if not impossible, to achieve by most conventional techniques.

Multilayer structures are thin-film materials that are periodic in one dimension in composition or in composition and structure. They are made by alternate deposition of two or more materials. Composition/structure variation is generated during the synthesis of the material, which is done using atom by atom, atom by molecule, or molecule by molecule technologies. Individual layers can be varied in thickness from one atomic layer (~2 Å) to thousands of atoms thick (>10,000 Å). Using this technology, multilayer structures can be formed with microstructures and compositions that are not possible using traditional processing technology.

Multilayer structured materials can be formed by several different techniques. Physical vapor deposition, chemical vapor deposition, electrochemical deposition, electrolytic deposition, and atomic layer epitaxy are all utilized to prepare multilayer materials. One common characteristic all of these techniques posses is that they use an atom-by-atom build up process. One type of physical vapor deposition involves sputtering. In sputter deposition systems atoms, or clusters of atoms, are generated in the vapor phase by bombardment of a solid source material with energetic particles. The substrate is moved past the source(s) and vapor condenses on the substrate to form a film. A single layer of material is deposited on the substrate with each pass. Adjusting the periodicity of substrate movement and/or the sputter generated vapor flux precisely controls the thickness of component layers (and thus its resulting physical properties). It is well known that the strength of metals is significantly increased by refinement of structural scale. Decreasing layer thickness from 2000 Å to 10 Å results in a strength increase of copper-Monel 400 multilayer by a factor of 5. For energetic nanolaminates, the variation of layer thickness enables control of the reactivity of a structure. Referring to FIG. 1, the measured reaction front velocity in a Monel 400-Aluminum energetic multilayer is plotted as a function of multilayer period. Layer thickness varies from 40 Å to 4000 Å and reaction front velocity varies from less than 1 m/sec to 17 m/sec. For example, a periodicity of 500 Å can be used to obtain a velocity of 8 m/sec, whereas a periodicity of 1000 Å can be used to obtain a velocity of 5 m/sec. Magnetron sputtering is one type of sputtering technique and it is the physical vapor method of choice for the semiconductor industry.

Over the last two decades, technology has been developed to deposit layers of atoms onto a substrate using magnetron-sputtering techniques. Articles such as, 1976 National Science Foundation Report to the United States Congress; "Development of Multilayer Synthesis Technology" by T. W. Barbee, Jr. in the Center of Materials Research at Stanford University selected as one of four major achievements in Materials Research resulting from programs funded by the Materials Office of the National Science Foundation during FY1976, herein incorporated by reference, T. W. Barbee, Jr. and D. L. Keith, "Synthesis of Metastable Materials by Sputter Deposition Techniques," Proc, at the Fall Meeting of the Metallurgical Society of AIME, Pittsburgh, Pa., Oct. 5-9, 1980, herein incorporated by reference, and T. W. Barbee, Jr., "Multilayer Synthesis by Physical Vapor Deposition," in Synthetic Modulated Structures, ed, by L. Chang and BC. Giessen, (Academic Press, New York, 1985), pp. 313-337, herein incorporated by reference, describe magnetron-sputtering techniques. Articles such as, Mann et al. in *J. Appl. Phys.* 1997, 82(3), 1178, herein incorporated by reference, and Gavens et al. in. *J. Appl. Phys.,* 2000, 87(3), 1255, herein incorporated by reference, describe recent advances in this technology. Layers of different metallic elements, each several nanometers thick, can be deposited on top of one another to make nanometer metallic multilayers. The properties of the multilayers are very dependent on structure and composition that can be conveniently controlled by changing reactor conditions. Certain multilayers can be engineered to be energetic, wherein the energy derived is from the rearrangement of some heteroelemental multilayers into stable chemical compounds. For example, silicon is an effective element to be included in an energetic multilayer. Energetic multilayers can be constructed using the majority of the elements in the periodic table. For example, a bi-metallic multilayer (i.e., a layer of a $1^{st}$ metal, followed by a layer of a $2^{nd}$ metal, followed by another layer of the $1^{st}$ metal, followed by another layer of the $2^{nd}$ metal, etc. . . . ), such as Al/Ni, can be rearranged to form its respective intermetallic (i.e., an alloy of the $1^{st}$ and $2^{nd}$ metal), $Al_3Ni_2$. Energetic multilayer structures have a period D for a particular composition of the multilayer structure, and an energy release rate constant K. Hereinafter, energetic multilayer structures are defined as multilayer structures having a selectable, (i) propagating reaction front velocity, (ii) reaction initiation temperature attained by application of external energy, and (iii) amount of energy delivered by a reaction of alternating unreacted layers of the multilayer structure. These energetic multilayer structures are adequately sensitive to both thermal and mechanical stimuli for standard initiation technologies to be applied. The stored energy and reaction velocities of the multilayers can be systematically and independently controlled by materials selection and size scale of the layers. A few examples of suitable energetic multilayer structures include Al/Monel™ 400, Ni/Al, Zr/Al, Ni/Si, Mo/Si, Pd/Al, Rh/Al, Ti/B, Ti/C, Zn/B, Ti/$B_4C$, and Zr/$B_4C$.

The energy release rate is determined by the reaction front velocity, the energy staved per unit volume of reactant, the volume of reactant consumed per unit time. The velocity is dependent on the specific heat of melting, diffusion within the solid and liquid states, and heat loss to the local environment. The following example is illustrative. Of the energy released from an Al/Monel 400 of an energetic multiplayer assuming a specific sample volume and no energy loss to the environment:

Al/Monel 400→Al(NiCu); energy release=about 1100 joules/gm

For a sample size approximately 50 μm×1 cm:

Area=1 cm×50×$10^{-4}$ cm=5×$10^{-3}$ $cm^2$ assume a velocity of 10 m/sec or 1000 cm/sec Volume=5×$10^{-3}$ $cm^2$×1000 cm/sec=5 $cm^3$ Density of NiAl=5.8 gm/$cm^3$ Therefore 5 $cm^3$ weighs 29 gms (5 $cm^3$×5.8 gm/$cm^3$).

Energy released=29 gms×1100 joules/gm=31,900 joules/sec=31.9 Kj/sec.

The energy release rate is directly proportional to the multiplayer cross-sectional area of the reacting foil. Therefore, 31,900 j/sec=31900×(1 cal/4.18 joule)=7,624 cal/sec or about 7.6 Kcal/sec.

In many cases the energetic in multilayer structures have the structural properties of a robust foil. Magnetron sputtering is very versatile. Nearly all metals can be utilized to make tailored energetic multilayer structures and thus compositional control is vast. The aging properties of multilayer materials are outstanding. Although the surface area of interfacial contacts in multilayer materials is very high, the area of material accessible to atmospheric gases is minimal. The manner in which the nanolaminate is built up, in a dense layer upon layer process, does not result in the incorporation of porosity into the nanostructure. Even though the nanolaminate has a large amount of interfacial contact area between the constituent phases, this contact area is not exposed to the ambient atmosphere. Thus, most of the internal surface area of the metallic layers are not exposed to ambient conditions which can lead to the hydrolysis and resulting degradation of the layer. Conversely, nanometersized powders of metallic fuel are very susceptible to hydrolysis under ambient conditions of temperature and humidity. (See Aumann, C. E.; Skofronick, G. L.; Martin, J. A. *J. Vac. Sci. Technol. B*1995, 13(3), 1178.

Metallic multilayer structures are known to have good environmental stability as they are currently used as precision reflective coatings on orbiting satellites such as the Transition Region and Corona Explorer (TRACE) and are thus exposed to harsh environments and stresses. Igniters comprising energetic multilayer structures coated with energetic booster materials can be tailored to be stable to environmental aging, i.e., where the igniters are exposed to extremes of both hot and cold temperatures (−30° C. to 150° C.) and both low (0%) and high relative humidity (100%).

Energetic multilayer structures can be prepared with tailored and precise reaction wave front velocities, energy release rates, and ignition temperatures. For example, the velocity of a multilayer thin film depends on the relative thickness and composition of each multilayer structure. Reaction front velocities from 0.2-100 meters/second can be prepared reliably and precisely. (see U.S. Pat. No. 5,538,795 Barbee et al col. 8 lines 21-37). Multilayer reaction temperatures between 200° C. and 1500° C. are observed for multilayers with different compositional and structural characteristics. (see. U.S. Pat. No. 5,538,795 Barbee et al col. 7 lines 6-13). Heats of reaction from 0.1 to 5 kj/g are capable with different multilayers. (see U.S. Pat. No. 5,538,795 Barbee). There have been several reports on the modeling and characterization of these properties and the influence of structure, composition, and processing conditions on such variables. (see Mann, A. B.; Gavens, M. E.; Reiss, M. E.; Van Heerden, D.; Bao, G.; Weihs, T. P. *J. Appl. Phys.* 1997, 82(3), 1178 and Gavens, A. J.; Van Heerden, D.; Mann, A. B.; Reiss, M. E.; Weihs, T. P. *J. Appl. Phys.,* 2000, 87(3), 1255.

Energetic booster materials include propellants, explosives, pyrotechnics, and other materials capable of generating high temperature exothermic reactions. Energetic boaster materials can also contain binder materials, such as Viton A-100™. Energetic nanocomposites that are effective as igniters, i.e., energetic nanocomposite igniters, can be fabricated by coating energetic booster materials onto energetic multilayer structures. Energetic booster materials include sol-gel nanostructured energetic materials, organic energetic compounds, inorganic energetic compounds, and energetic nano-particulates. Sol-gel nanostructured energetic materials are intimate mixtures of an oxidizer(s) and fuel(s) where at least one of the critical dimensions (length, height, width) of at least one of the constituents is less than 100 nm and where at least one of the components of the energetic materials was derived via sol-gel methods known to those skilled in the art. Sol-gel methods comprise dissolving a sol-gel molecular precursor in solution and then through the manipulation of any one or more of several variables (e.g., pH, ionic strength, temperature) inducing the hydrolysis and condensation of the molecular precursors into a sol, i.e.,—a liquid solution with very small solid particles suspended in it, and causing the sol to condense and solidify to form a rigid 3-dimensional gel monolith. An example would be the energetic materials $Fe_2O_3$/Al nanocomposite. Organic energetic compounds are molecular, ionic, or polymeric compounds those whose combination of oxidizer(s) and fuel(s) are limited to consist of the elements of carbon, hydrogen, oxygen, nitrogen, chlorine, and fluorine, e.g., the energetic material nitrocellulose. Inorganic energetic compounds are molecular, ionic, or polymeric compounds that are made up primarily of elements other than those defined as organic. Lead azide ($Pb(N_3)_2$) is an example of an inorganic energetic material. Energetic nanoparticulates are physical mixtures of oxidizer(s) and fuel(s) where at least one is a powder and that powder comprises particles whose nominal average diameter is between 1 and 100 nm, e.g., Metastable Intermolecular Composites (MIC) materials that are made up of nanometersized powders of $MoO_3$ (oxidizer) and Al (fuel). (see Son et. al. *Proc.* 28$^{th}$ *International Pyro Sem.* Adelaide Australia, November 2001 and Son et. al. *Proc.* 29$^{th}$ *International Pyro Sem.* Westminster, Colo. U.S.A., July 2002 p. 203). Dip-coating, spin-coating, spray-coating, chemical vapor deposition coating, physical vapor deposition coating, lamination and gluing are all effective methods of coating the energetic booster material onto the energetic multilayer structure.

Energetic nanocomposite igniters can be ignitable by one or all of the following methods: (1) mechanical stimuli, (2) electrical energy, or (3) a laser. The sensitivity to ignition by mechanical, laser, and electrical means can be controlled by fabrication of a particular composition. The amount of energy output varies from composition to composition and is also controllable by fabrication of a particular composition. The size of the energetic nanocomposite igniter can range from the very small to the very big. There is no limitation as to size, however, typically the area of the igniter ranges from $10^{-12}$ $m^2$ to 10 $m^2$.

Sol-Gel Methodology

Sol-gel chemical methodology has been extensively employed in the disciplines of chemistry, materials science, and physics. Sol-gel chemistry is a solution phase synthetic route to highly pure organic or inorganic materials that have homogeneous particle and pore sizes as well as densities. One benefit gel chemistry is the convenience of low-temperature preparation using general and inexpensive laboratory equipment. Sol-gel chemistry affords the control over the stoichiometry and homogeneity that conventional methods lack and enables the production of materials with special shapes such as monoliths, fibers, films, coatings, and powders of uniform and very small particle sizes.

The pH of the solution, the solvent, the temperature, and the concentrations of reactants used can dictate the size of the sol clusters. Sol clusters are formed through the successive hydrolysis and condensation of many sol-gel molecular clusters. For instance one molecular precursor undergoes hydrolysis and then another does. The two hydrolyzed precursors can undergo condensation to form a dimer and then attach another hydrolyzed precursor to form a trimer and so on. Depending on many factors such as catalyst, temperature, and concentration of monomer, this polycondensation occurs until oligomers of such size as 1-1000 nm in diameter exist in solution. Sol clusters can be from 1 nm to 1000 nm in diameter. By controlling the conditions in solution, the sol can be condensed into a robust gel. The linking together of the sol dusters into either aggregates or linear chains results in the formation of a stiff monolith. The gel can be dried by evaporation of the solvent to produce a xerogel or the solvent can be removed under the supercritical conditions of the pore liquid to produce an aerogel. (see Brinker, C. J.; Scherer G. W. *Sol-gel Science: The Physics and Chemistry of Sol-gel Processing*, Academic Press: San Diego, 1990). The gel structures produced by either method are typically very uniform because the particles and the pores between them are nanometer-sized. This homogeneity leads to uniform materials properties of sol-gel derived materials.

The morphology, size, and composition of components of energetic nanocomposites as well as enhancing their intimate mixing is described in Tillotson et al., *J. Non-Cryst. Solids* 2001, 285, 338-345, incorporated herein by reference. Sol-gel synthetic routes to highly pure, high surface area, small particle size, inorganic oxides (i.e., oxidizers) and organic (i.e., fuel) sol-gel materials have been developed. (see Tillotson et al, U.S. patent application Ser. No. 09/586,426, herein incorporated by reference, Gash et al., *Chem. Mater.* 2001, 13, 9999, herein incorporated by reference, and Gash et al., *J. Non-Cryst. Solids* 2001, 285, 22-28, herein incorporated by reference). Using the sol-gel methodology, structural and compositional parameters can be manipulated on the nanoscale.

The initiation mixture components and their reaction products can be non-toxic, non-hazardous and environmentally benign. The precursor compounds utilized in the preparation of the sol-gel materials are prepared from inorganic metal salts are economical, non-toxic, safe, and easy to handle and dispose of (see Gash et al, *Chem. Mater.* 2001, 13, 999 and Gash et al., *J. Non-Cryst. Solids* 2001, 285, 22-28). The solvents used in the synthesis can be water or simple alcohols like ethanol. These types of solvents are advantageous as they are non-toxic, non-hazardous, cost-effective, and do not pose any major disposal problems. The sol-gel process is also amenable to spin-coating and spray-coating technologies, chemical vapor deposition coating, physical vapor deposition coating, as well as lamination and gluing to coat surfaces. FIG. 2*a* shows an energetic multilayer nanocomposite igniter that comprises an energetic sol-gel booster material ($Fe_3O_2$/Al) coated onto an energetic bi-metallic multilayer foil (Ni/Al). The coated portion of the multilayer is on the left end of the foil. FIG. 2*b* illustrates that mechanical initiation of the nanocomposite igniter, using a spring-loaded punch, results in ignition of the energetic sol-gel coating. In FIG. 2*b* a spring-loaded punch was used to mechanically initiate the bi-metallic multilayer foil to react. As can be seen from the image, the mechanical stimulus induces the exothermic transformation of the bi-metallic multilayer to its respective intermetallic alloy. The arching glowing foil indicates that the transformation propagates along the foil perpendicular to the punch and migrates to the energetic sol-gel-coated region of the foil.

Examples

A convenient and generic method for incorporating organic gas generating constituents into energetic ceramic/fuel metal thermite composites is described herein. A ceramic/fuel metal thermite composite comprises a metal oxide component and a fuel metal component, that with the proper thermal, mechanical, shock, or electrical input will undergo the very exothermic, and well-known thermite reaction as described by Goldschmidt (see Goldschmidt, H. *Iron Age,* 1908, 82, 232. Energetic bi-metallic multilayer structure foils can be dip-, spin-, or spray-coated with thermite-based sol-gel materials. The conversion of a bi-metallic multilayer to its respective intermetallic generates sufficient energy to ignite the ceramic/fuel metal thermite composite coating. Such composite material(s) have sufficient energy output when ignited to initiate transfer charges.

Both ultra fine grained (UFG) nanometer-sized (~30-100 nm diameter) Al and conventional micron-sized Al can be used in nanocomposites. Al powders can also be incorporated into other non-sol-gel energetic coatings. Micron-sized Al is an effective and reliable component of many energetic materials. Although less reactive than the metastable intermolecular composite (MIC) Al, the micron Al has a greater energy density, is safer to work with, and has better aging properties. Micron Al results in more reproducible performance in applications.

Figure 2:
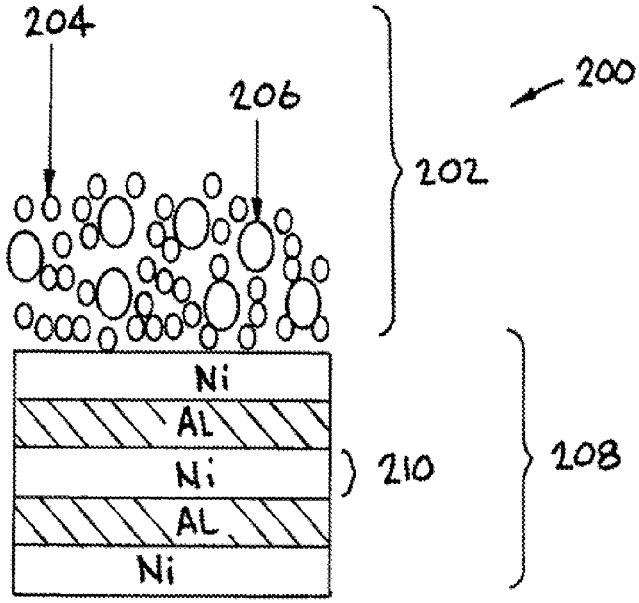
FIG. 2 shows the microstructure of an $Fe_2O_3$/Al energetic sol-gel coated Ni/Al energetic multilayer structure nanocomposite.

The microstructure of an $Fe_2O_3$/Al energetic sol-gel coated Ni/Al energetic multilayer structure nanocomposite 200 is shown in FIG. 2, proportions of the individual components are not to uniform scale. An energetic sol-gel coating 202 ranging from 0.1 μm to 500 μm comprises two components: (1) the sol-gel oxidizer network 204 comprises particles ranging from 5 nm to 500 nm and (2) the fuel metal component 206 comprises particles ranging from 20 nm to 20,000 nm. A metallic multilayer foil 208 ranging from 10 μm to 40 μm comprises layers of alternating metal species 210 ranging from 2 nm to 1,000 nm. Experiments have indicated that the conversion of the Ni/Al multilayer to its respective intermetallic generates sufficient energy to ignite the more energetic $Fe_2O_3$/Al composite coating.

Figure 3A:
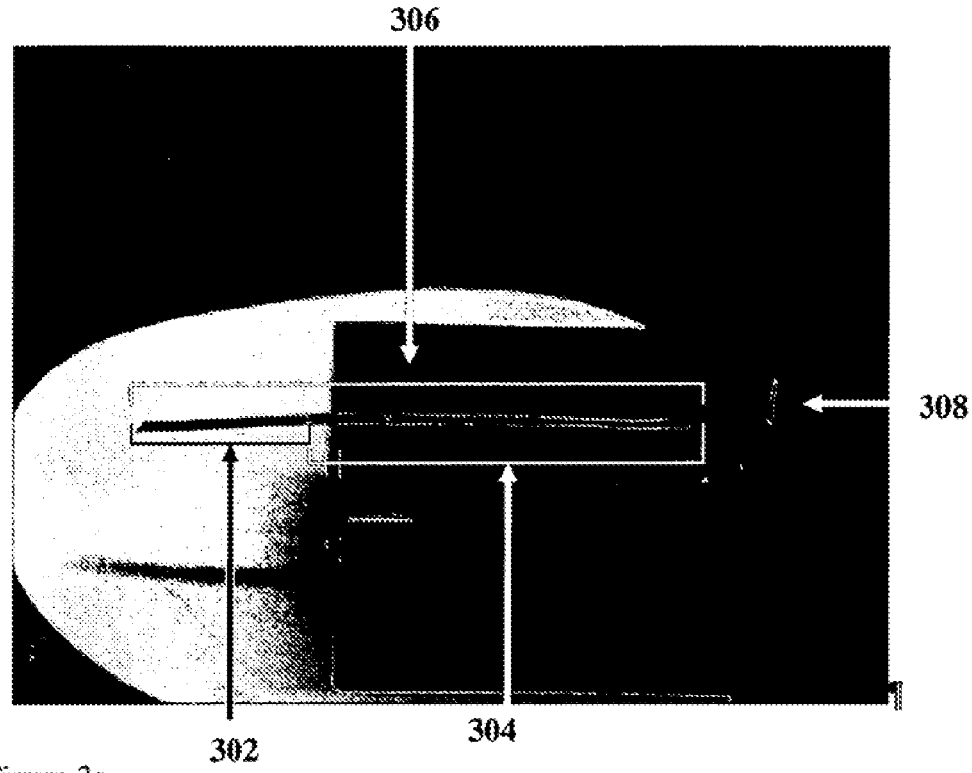
FIG. 3*a* shows, an energetic nanocomposite comprising an energetic sol-gel booster material ($Fe_30_2$/Al) coated onto an energetic bi-metallic multilayer foil (Ni/Al) igniter.
Figure 3B:
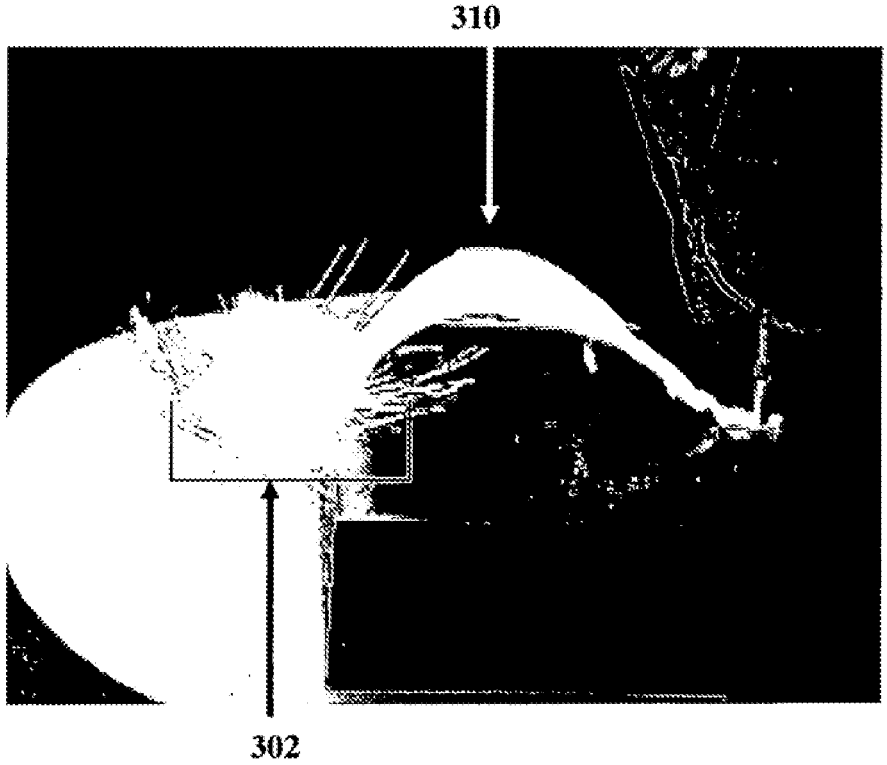
FIG. 3*b* illustrates the result of mechanical initiation of the energetic multilayer nanocomposite igniter.

FIGS. 3*a* and 3*b* are still photos of the sequential mechanical initiation of a nanocomposite igniter 306 that comprises an energetic Ni/Al nanolaminate foil 304 with one end coated with sol-gel 302 thermite. Referring to FIG. 3*a* an energy devise sol-gel thermite 302 coats the end of the nanolaminate foil 304. FIG. 3*a* is a still photo before ignition and 3*b* is a still photo after ignition. Referring to FIG. 3*b*, the NiAl nanolaminate foil transforms exothermally to the corresponding intermetallic alloy and has sufficient energy release to ignite the more energy dense sol-gel thermite ($Fe_2O_3$/Al) that is coated on the end of the foil (far left hand tip of the foil). The $Fe_2O_3$/Al nanocomposites ignite and burn at temperatures exceeding 3000 K. Other thermite reactions are known to reach temperatures of 4000K.

The initiation mixture components and their reaction products, from this particular nanocomposite, are non-toxic, non-hazardous and environmentally benign. The base $Fe_2O_3$/Al composite and its reaction products $Al_2O_3$ and Fe metal are frequently used in many common industries on a commodity scale. The precursor compounds utilized in the preparation of the sol-gel materials are prepared from the inorganic metal salts (e.g., ferric chloride and ferric nitrate), economical, non-toxic, safe, and easy to handle and dispose of. Details regarding the precursor compounds are described in Gash et al., *Chem. Mater.* 2001, 13, 999 and Gash et al., *Non-Cryst. Solids* 2001, 285, 22-28. The solvents used in the synthesis can be water or simple alcohols like ethanol. These solvents are advantageous as they are non-toxic, non-hazardous, cost-effective, and do not pose any major disposal problems. The energetic multilayer structure foil used in this case comprises alternating layers of aluminum and nickel. The mechanical stimulus initiates the rearrangement of the multilayers to their alloy $Al_3Ni_2$, which is an inert safe solid material.

Referring again to FIG. 3*a*, initiation of the nanocomposite, 306 using a spring-loaded punch, 308 results in ignition of the energetic sol-gel coating 302. The photo in FIG. 3*b* shows the result of using a spring-loaded punch to mechanically initiate the multilayer foil to react. The mechanical stimulus induces the exothermic transformation of the Ni/Al multilayer to its respective intermetallic alloy, $Al_3Ni_2$. The arching glowing foil 310 indicates that the transformation propagates along the foil perpendicular to the punch and migrates to the energetic sol-gel-coated region 302 of the foil. This reaction has sufficient output energy to ignite the more energy dense $Fe_2O_3$/Al sol-gel thermite reaction which is known to reach temperatures in excess of 3100° C. Other thermite reactions are known to reach temperatures of ~4000K. The theoretical energy release that is expected for the Ni/Al intermetallic reaction is 330 cal/g. The more energy dense $Fe_2O_3$/Al sol-gel thermite reaction has a heat of reaction of 950 cal/g.

Hitch et al, *Am. Chem. Soc.* 1918, 40, 1195 and Kohler et al., *Explosives*, VCH: Weinheim, 1993, pp. 212-213, which are herein incorporated by reference, describe the intermediate/transfer charge in current stab detonators, i.e., lead azide. Lead azide is highly sensitive to impact, heat shock, and friction. Thermal decomposition of $Pb(N_3)_2$ leads to deflagration above 320° C. and explosion above 345° C. A device (s) comprising energetic sol-gel coated multilayers when initiated by mechanical stimuli will generate sufficiently high temperatures as to lead to decomposition/deflagration/detonation of the $Pb(N_3)_2$ transfer charge. The multilayer is sensitive to mechanical impact that will induce its exothermic rearrangement to an intermetallic. The sol-gel energetic material undergoes the basic thermite process discovered by Goldschmidt. (see Rithter et al., in *Energetic Materials, Physics and Chemistry of the Inorganic Azides*; Plenum Press: New York, 1977, pp 15-86. Thermite reactions have been extensively investigated and it has been demonstrated that those that are self-propagating reach temperatures above 2000K (see Goldschmidt, H. *Iron Age,* 1908, 82, 232). The example depicted in FIG. 3*a* and FIG. 3*b* of such an initiating mixture utilizes the "traditional" thermite reaction:

$$Fe_2O_3+2Al \text{------>} Al_2O_3+Fe\Delta H_{rxn}=0.95 \text{ kcal/g; reaction temp.}=3135 \text{ k}$$

Other thermite reactions are listed in Table 1 below.

TABLE 1

Thermite reactions

| Reaction | Temperature (K) | Heat of Reaction (cal/g) |
|---|---|---|
| $2Al + Fe_2O_3$ | 3135 | 945 |
| $24Al + MnO_2$ | 2918 | 1159 |
| $2Al + WO_3$ | 3253 | 697 |
| $2Al + MoO_3$ | 3253 | 1124 |

TABLE 1-continued

| Thermite reactions | | |
|---|---|---|
| Reaction | Temperature (K) | Heat of Reaction (cal/g) |
| $10Al + V_2O_5$ | 3273 | 1092 |
| $2Mg + MnO_2$ | 3271 | 1322 |
| $2Mg + Fe_2O_3$ | 3135 | 1110 |

All numbers expressing quantities of ingredients, constituents, reaction conditions, and so forth used in the specification and claims are to be understood as being modified in all instances by the term "about". Notwithstanding that the numerical ranges and parameters setting forth the broad scope of the subject matter presented herein are approximations, the numerical values set forth in the specific examples are reported as precisely as possible. Any numerical value, however, inherently contain certain errors necessarily resulting from the standard deviation found in their respective testing measurements.

While, various materials, parameters, operational sequences, etc. have, been described to exemplify and teach the principles of this invention, such are not intended to be limited. Modifications and changes may become apparent to those skilled in the art; and it is intended that the invention be limited only by the scope of the appended claims.

We claim:

1. A method for producing a composition, comprising coating an energetic multilayer structure with an energetic booster material, wherein Said energetic booster material is coated onto one end or one side of said multilayer structure, wherein said energetic booster material comprises a sol-gel nanostructured energetic material.

2. The method of claim 1, wherein said composition is ignitable by mechanical stimuli.

3. The method of claim 1, wherein said composition is ignitable by electrical energy.

4. The method of claim 1, wherein said composition is ignitable by a laser.

5. The method of claim 1, wherein said composition comprises an igniter that has an area ranging from $10^{-2}$ $m^2$ to $10^2$ $m^2$.

6. The method of claim 1, wherein said energetic multilayer structure comprises a bi-metallic multilayer.

7. The method of claim 1, wherein said bi-metallic layer is Ni/Al.

8. The method of claim 1, wherein said sol-gel nanostructured energetic material is a $Fe_2O_3$/Al nanocomposite.

9. The method of claim 1, wherein said sot-gel nanostructured energetic material comprises a nanocomposite selected from the group consisting of $MnO_2$/Al, $WO_3$/Al, $MoO_3$/Al, $V_2O_5$/Al, $MnO_2$/Mg and $Fe_2O_3$/Mg.

10. The method of claim 1, wherein said sol-gel nanostructured energetic material comprises a mixture of at least one oxidizer and at least one fuel.

11. The method of claim 10, wherein at least one dimension of at least one of the constituents of said mixture is less than 100 nm, wherein said at least one dimension is selected from the group consisting of length, height and width.

12. The method of claim 1, wherein the step of coating is accomplished by dip-coating, spin-coating, spray-coating, chemical vapor deposition coating, physical vapor deposition coating, lamination, or gluing.

* * * * *